US012798728B2

(12) United States Patent
Tian

(10) Patent No.: US 12,798,728 B2
(45) Date of Patent: Nov. 17, 2026

(54) WATER TRANSPORTATION SYSTEM INCLUDING A PERSONAL WATERCRAFT, A WATER PLATFORM, AND A LOCKING DEVICE

(71) Applicant: SHANGHAI YUJET, CO. LTD., Kunshan City (CN)

(72) Inventor: Yu Tian, Hong Kong (HK)

(73) Assignee: SHANGHAI YUJET CO., LTD., Jiangsu Province (CN)

( * ) Notice: Subject to any disclaimer, the term of this patent is extended or adjusted under 35 U.S.C. 154(b) by 260 days.

(21) Appl. No.: 18/418,893

(22) Filed: Jan. 22, 2024

(65) Prior Publication Data

US 2024/0199174 A1 Jun. 20, 2024

Related U.S. Application Data

(63) Continuation-in-part of application No. 18/314,058, filed on May 8, 2023, now Pat. No. 11,912,376.

(Continued)

(30) Foreign Application Priority Data

| | | |
|---|---|---|
| Jul. 8, 2022 | (CN) | 202210804854.X |
| Jul. 8, 2022 | (CN) | 202210805802.4 |
| Jul. 8, 2022 | (CN) | 202210807458.2 |
| Jul. 8, 2022 | (CN) | 202210808130.2 |
| Jul. 8, 2022 | (CN) | 202210808181.5 |
| Jul. 8, 2022 | (CN) | 202210815527.4 |
| Oct. 28, 2022 | (CN) | 202211331990.8 |
| Oct. 28, 2022 | (CN) | 202211332030.3 |
| Oct. 28, 2022 | (CN) | 202211332542.X |
| Oct. 28, 2022 | (CN) | 202211332654.5 |
| Oct. 28, 2022 | (CN) | 202211332676.1 |
| Oct. 28, 2022 | (CN) | 202211341386.3 |

(Continued)

(51) Int. Cl.
*B63B 21/58* (2006.01)
*B63B 21/56* (2006.01)

(Continued)

(52) U.S. Cl.
CPC ..... *B63B 21/58* (2013.01); *B63B 34/10* (2020.02); *B63B 2021/563* (2013.01); *B63B 21/62* (2013.01)

(58) Field of Classification Search
CPC ... B63B 21/58; B63B 21/62; B63B 2021/563; B63B 34/10

(Continued)

(56) References Cited

U.S. PATENT DOCUMENTS 3,461,829 A * 8/1969 Mosvold ..... B63B 35/70 114/249
3,923,220 A * 12/1975 Marcyan ..... B60R 9/10 224/570

(Continued)

*Primary Examiner* — Stephen P Avila
(74) *Attorney, Agent, or Firm* — WPAT LAW, P.C.; Anthony King

(57) ABSTRACT

A water transportation equipment wherein the water transportation equipment has a water platform, the water platform includes a platform body and a platform extension. A personal watercraft is connected to the water platform via a locking device attached to the handlebar of the personal watercraft. The platform extension is detachably connected to the personal watercraft through the locking device.

8 Claims, 4 Drawing Sheets

Related U.S. Application Data

(60) Provisional application No. 63/480,716, filed on Jan. 20, 2023.

(30) Foreign Application Priority Data

| | | |
|---|---|---|
| Oct. 28, 2022 | (CN) | 202211341387.8 |
| Oct. 28, 2022 | (CN) | 202211341848.1 |
| Jul. 8, 2023 | (CN) | 202210807921.3 |
| Jul. 8, 2023 | (CN) | 202210815528.9 |

(51) Int. Cl.
*B63B 21/62* (2006.01)
*B63B 34/10* (2020.01)

(58) Field of Classification Search
USPC ..... 114/258, 249
See application file for complete search history.

(56) References Cited

U.S. PATENT DOCUMENTS

| | | | | |
|---|---|---|---|---|
| 4,694,770 | A * | 9/1987 | Kitner | B63B 34/10 114/352 |
| 5,775,250 | A * | 7/1998 | Kobayashi | B63B 35/70 114/258 |
| 2006/0048692 | A1 * | 3/2006 | Kawai | B63B 35/40 441/6 |

* cited by examiner

WATER TRANSPORTATION SYSTEM INCLUDING A PERSONAL WATERCRAFT, A WATER PLATFORM, AND A LOCKING DEVICE

CROSS-REFERENCES

This application claims priority to, and is a non-provisional application of, U.S. provisional application No. 63/480,716, filed Jan. 20, 2023.

This application is a continuation-in-part application of U.S. utility patent application Ser. No. 18/314,058, filed on May 8, 2023, now allowed, which claims priority to, and is a non-provisional patent application of, U.S. provisional patent application No. 63/480,716, filed on Jan. 20, 2023, all of which is hereby incorporated by reference in their entireties.

This application is a continuation-in-part application of U.S. utility patent application Ser. No. 18/314,058, filed on May 8, 2023, now allowed, which claims priority to China Invention Patent Application number 202211332654.5, filed on Oct. 28, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202211332676.1, filed on Oct. 28, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202211341386.3, filed on Oct. 28, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202211341387.8, filed on Oct. 28, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202211341848.1, filed on Oct. 28, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202211332030.3, filed on Oct. 28, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202211332542.X, filed on Oct. 28, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202211331990.8, filed on Oct. 28, 2022, now pending, which is hereby expressly incorporated by reference as part of the present disclosure.

This application is a continuation-in-part application of U.S. utility patent application Ser. No. 18/314,058, filed on May 8, 2023, filed on May 8, 2023, now allowed, which claims priority to China Invention Patent Application number 202210807458.2, filed on Jul. 8, 2022, now pending, which is hereby expressly incorporated by reference as part of the present disclosure.

This application is a continuation-in-part application of U.S. utility patent application Ser. No. 18/314,058, filed on May 8, 2023, filed on May 8, 2023, now allowed, which claims priority to China Invention Patent Application number 202210805802.4, filed on Jul. 8, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202210804854.X, filed on Jul. 8, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202210807921.3, filed on Jul. 8, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202210815528.9, filed on Jul. 8, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202210808130.2, filed on Jul. 8, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202210808181.5, filed on Jul. 8, 2022, now pending, which is hereby expressly incorporated by reference as part of the present disclosure.

This application is a continuation-in-part application of U.S. utility patent application Ser. No. 18/314,058, filed on May 8, 2023, now allowed, which claims priority to China Invention Patent Application number 202210815527.4, filed on Jul. 8, 2022, now pending, which is hereby expressly incorporated by reference as part of the present disclosure.

FIELD OF THE DISCLOSURE

The invention relates to the technical field of watercrafts, in particular to a locking device connecting a personal watercraft to a water transportation equipment.

BACKGROUND OF THE INVENTION

As a small vessel, personal watercraft is becoming more and more popular due to their flexible operation and low cost. However, there remains a need to lock a personal watercraft to another vessel.

SUMMARY OF THE INVENTION

The purpose of the invention is to provide a locking device to connect a personal watercraft to a water transportation equipment. The present application is to provide a water transportation equipment that is suitable for multiplayer entertainment, is simple to operate, and has low cost.

For this purpose, the first aspect of the invention provides a water transportation equipment, the water transportation equipment comprises: a water platform, the water platform includes a platform body and a platform extension; a personal watercraft, the front part of the personal watercraft is provided with a handlebar, the handlebar controls the steering of the personal watercraft; the handlebar is provided with a locking device, and the platform extension is detachably connected to the personal watercraft through the locking device, the water platform is driven to move when the personal watercraft is started.

Moreover, the front part of the personal watercraft is arranged toward the water platform.

Moreover, the end of the platform extension is configured to be able to enter and exit the locking device so that the platform extension can be detachably connected to the personal watercraft.

Moreover, the end of the platform extension is configured to be able to be moved in the height direction inside the locking device after entering the locking device.

Moreover, the locking device includes a pair of semi-closed rings, each semi-closed ring includes a first opening, and the end of the platform extension is configured to be able to enter and exit the pair of semi-closed rings through the pair of first openings, so that the platform extension can be detachably connected to the personal watercraft.

Moreover, the locking device further includes a pair of locking elastic bands, and the end of the platform extension is further bound to the handlebar through the pair of locking elastic bands.

Moreover, the end of the platform extension includes a cross bar, the cross bar is configured to be able to enter and exit the pair of semi-closed rings and to be fastened to the handlebar by the locking elastic bands.

Moreover, the semi-closed ring includes a top ring part, a bottom ring part, and a connecting part, wherein the connecting part connects the top ring part and the bottom ring part, the cross bar is configured to enter the the pair of semi-closed rings through the first opening between the top ring part and the bottom ring part.

Moreover, the platform extension is configured to rotate around the side edge of the water platform between a direction parallel to the water surface and a direction perpendicular to the water surface.

Moreover, further comprising a pair of personal watercrafts, the front and rear sides of the water transportation equipment respectively include a platform extension, wherein the platform extension on the front is connected to one watercraft, and the platform extension on the rear is connected to another personal watercraft.

The water transportation equipment of the present application is to provide a water transportation equipment that is suitable for multiplayer entertainment, is simple to operate, and has a low manufacturing cost.

DETAILED DESCRIPTION

The different aspects of the various embodiments can now be better understood by turning to the following detailed description of the embodiments, which are presented as illustrated examples of the embodiments as defined in the claims. It is expressly understood that the embodiments as defined by the claims may be broader than the illustrated embodiments described below.

As used herein, the term "personal watercraft" or "PWC" refers to a type of recreational watercraft that is designed for one to three people to ride on. It is commonly known by brand names such as Jet Ski™, WaveRunner™, and Sea-Doo™. It is typically ridden like a scooter if a seat is offered. It may also be without a seat and the rider would ride it standing up.

Figure 1:
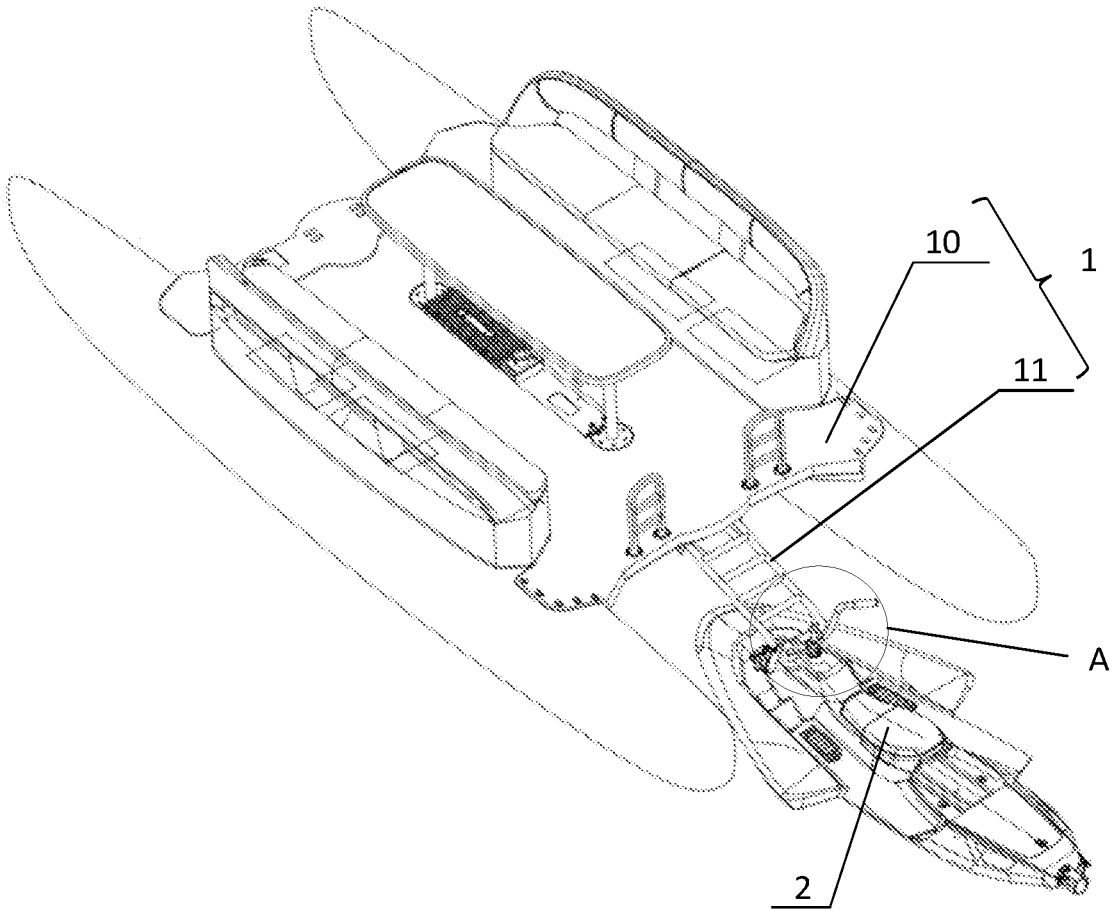
FIG. 1 shows the schematic structural diagram of the water transportation equipment provided by the first embodiment of the present invention.
Figure 2:
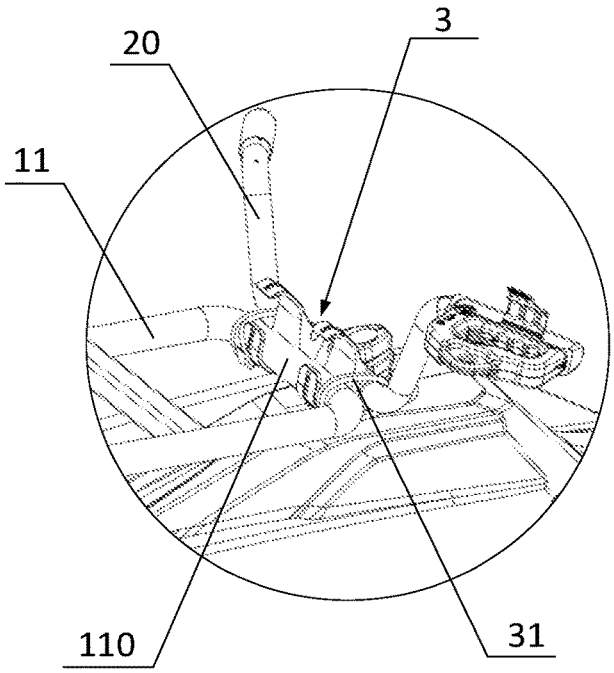
FIG. 2 shows the enlarged view of position A in FIG. 1.

The following describes embodiments of the present application with reference to the accompanying drawings. As shown in FIGS. 1 and 2, the water transportation equipment of the present application includes a water platform 1. The water platform 1 includes a platform body 10 and a platform extension 11. The front part of the personal watercraft 2 is provided with a handlebar 20, the handlebar 20 controls the steering of the personal watercraft 2. The handlebar 20 is provided with a locking device 3, and the end of the platform extension 11 can enter and exit the locking device 3 and is detachably connected to the personal watercraft 2 through the locking device 3. In this way, the water platform 1 is fixedly connected to the handlebar 20 through the platform extension 11, and the water watercraft 2 can drive the water platform 1 forward. The platform extension 11 can take the form of a ladder or an extended bar having at least one horizontal rung.

Figure 3:
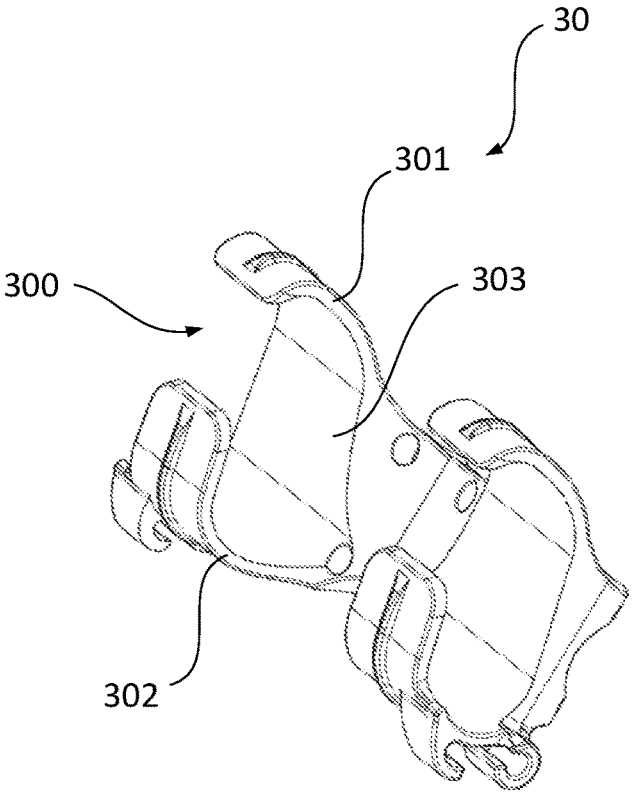
FIG. 3 shows the schematic structural diagram of the semi-closed ring of the locking device provided by the first embodiment of the present invention.

Specifically, as shown in FIGS. 2 and 3, the locking device 3 includes a pair of semi-closed rings 30. The semi-closed ring 30 includes a top ring part 301, a bottom ring part 302, and a connecting part 303 connecting an end of the top ring part 301 and an end of the bottom ring part 302. The semi-closed rings 30 further includes a first opening 300. The first opening 300 separates one end of the top ring part 301 from another end of the bottom ring part 302. The bottom ring part 302 can be longer than the top ring part 301. The end of the platform extension 11 includes a crossbar 110 (e.g., a rung). The crossbar 110 can enter and exit the semi-closed ring 30 through the first opening 300. The semi-closed ring 30 allows the crossbar 100 to rest and be cradled at the bottom of the bottom ring part 302 (as shown in FIG. 2), which prevents the crossbar 110 from moving in a direction perpendicular to a height direction which will be defined below. In one particular embodiment, the horizontal distance between the bottom ring part 302 and the connecting part 303 is just sufficiently wide to receive the crossbar 110, but does not allow additional horizontal movement for the crossbar 110 when the crossbar 110 is cradled within the bottom ring part 302.

Furthermore, when being used in chopping waters, the displacement of water platform 1 in the height direction (i.e., vertical direction) can be different from that of the personal watercraft 2 in the height direction. In this way, the crossbar 110 of the platform extension 11 is allowed to freely move in the height direction inside the locking device 3. Such free movement minimizes the impact of the displacement of the water platform 1 that may have on the personal watercraft 2. For example, when a wave causes the water platform 1 and its associated crossbar 110 to suddenly move vertically upward, the crossbar 100 would freely move upward within the allowed range of height-direction movement in the semi-closed ring 30. This can dampen the shaking that would otherwise pass onto the rather smaller personal watercraft 2. This can also help minimize damage to the structural integrity of the locking device 3, the handlebar 20, and the personal watercraft 2.

Furthermore, the locking device 3 can further include a pair of locking elastic bands 31 (see FIG. 2), and the end of the platform extension 11 is further bound to the handlebar 20 through the locking elastic bands 31. It is more difficult for the crossbar 110 to escape from the semi-closed ring 30 during its up and down swing over chopping waters.

Furthermore, the platform extension 11 is configured to be able to pivot about the side edge of the water platform 1 between a position parallel to the water surface and a position perpendicular to the water surface, so that the water platform 1 can dock with the handlebar 20 of the personal watercraft 2 more easily. When disconnected from the personal watercraft 2, the platform extension 11 can be placed perpendicular to the water surface and be used as a ladder.

Figure 4:
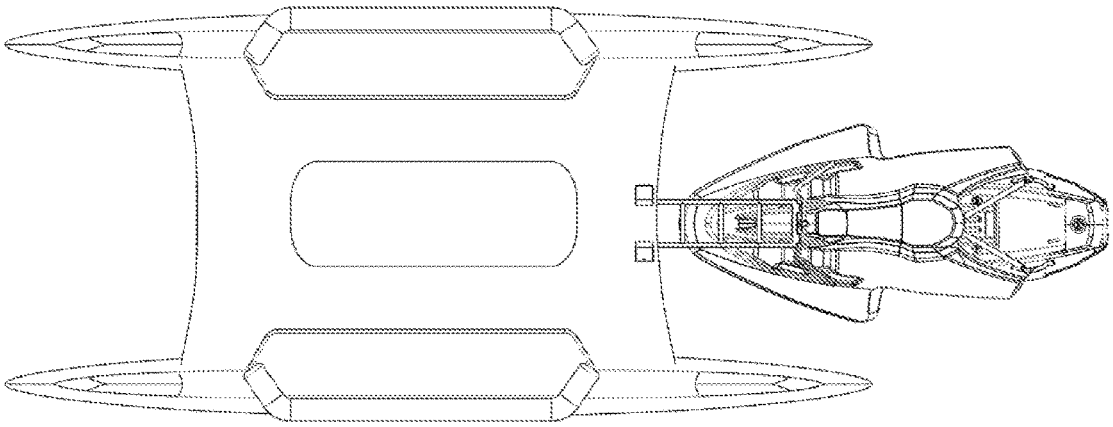
FIG. 4 shows a top view of the water transport vehicle in a straight-running state provided by the first embodiment of the present invention.
Figure 5:
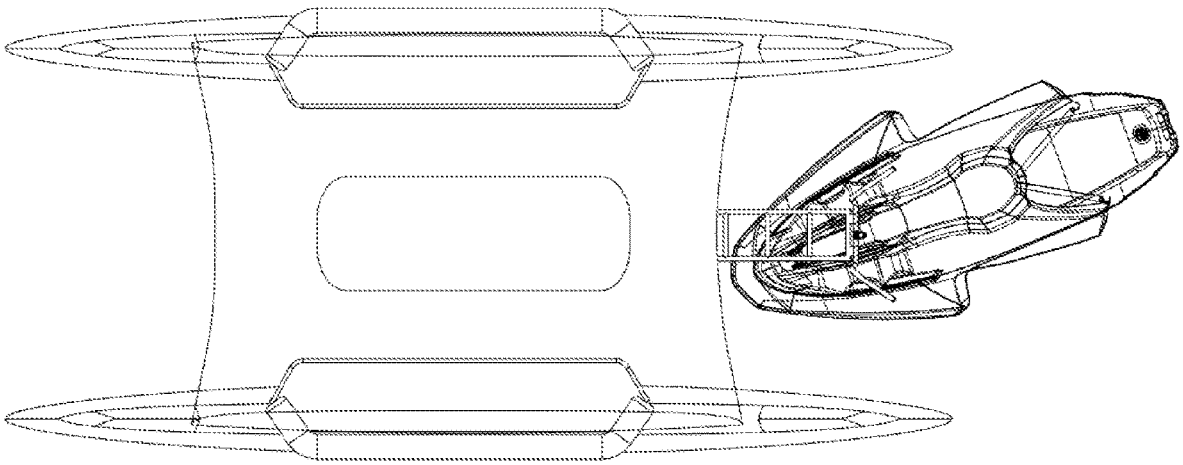
FIG. 5 shows a top view of the water transport vehicle in a right-turning state provided by the first embodiment of the present invention.

Furthermore, the front part of the personal watercraft 2 is arranged toward the water platform 1. As shown in FIG. 4, the personal watercraft 2 pushes the water platform 1 forward in a straight-running state. When turning is required, the handlebar 20 is turned in the direction to be turned, so that the body axis of the personal watercraft 2 and the platform axis of the water platform 1 are offset, and then the water platform 1 is turned driven by the power of the personal watercraft 2. FIG. 5 shows a state in which the water personal watercraft 2 pushes the water platform 1 to turn right by turning the handlebar to the right, and FIG. 6 shows a state in which the personal watercraft 2 pushes the water platform 1 to turn left by turning the handlebar in the left direction.

Figure 6:
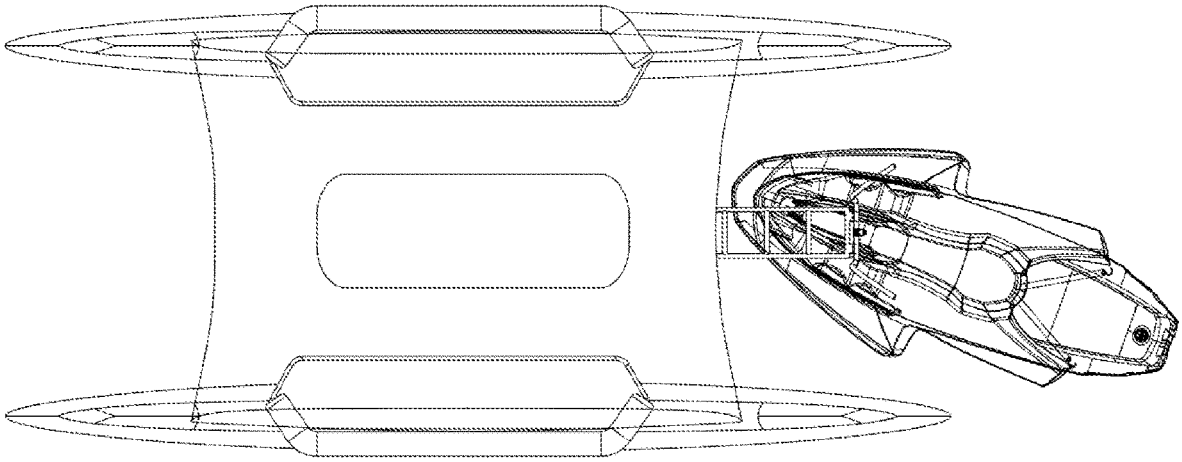
FIG. 6 shows a top view of the water transport vehicle in a left-turning state provided by the first embodiment of the present invention.

In FIGS. 4, 5, and 6, the front part of the personal watercraft 2 is arranged toward (i.e., facing) the water platform 1. Compared with setting the personal watercraft 2 in front of the water platform 1, this setting makes it easier to control the steering of the water platform 1 by the left to right swing movement of the personal watercraft 2 as shown in FIGS. 4, 5, and 6, and is more energy-saving. At the same time, the platform extension 11 can be used as a ladder; it is more convenient for the user to move between the personal watercraft 2 and the water platform 1.

Figure 7:
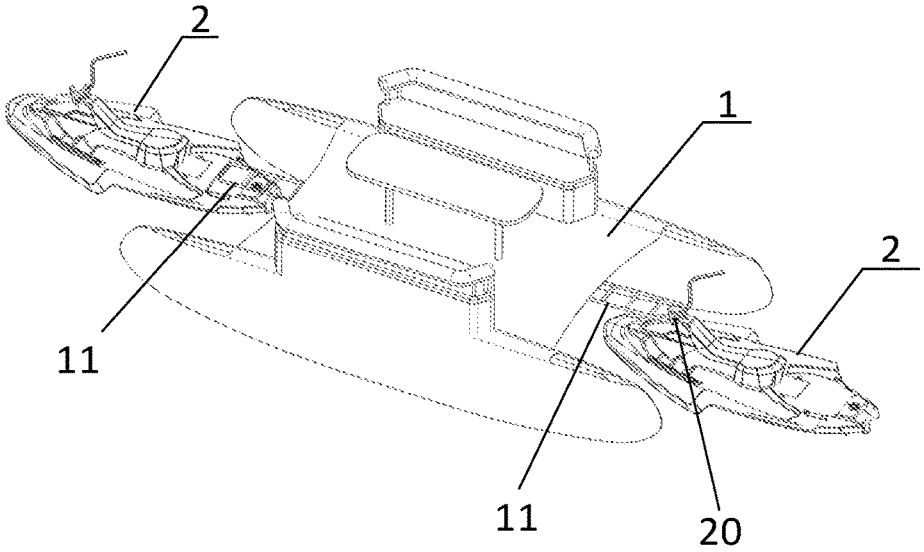
FIG. 7 shows the schematic structural diagram of the water transportation equipment provided by the second embodiment of the present invention.

In FIG. 7, the water transportation equipment in the second embodiment of the present application includes two personal watercrafts 2. The front and rear sides of the water platform 1 each includes a platform extension 11, wherein the front platform extension 11 is connected to the tail of one personal watercraft 2. The connection can be made by a tether, such as a rope. The platform extension 11 on the rear side is connected to the handlebar 20 as previously described.

The water transportation equipment of the present application is suitable for multiplayer entertainment, is simple to operate, and has low manufacturing cost.

The above embodiments only illustrate the principles and effects of the present application. Anyone familiar with this technology can modify or change the above embodiments without violating the purpose of this application. Therefore, all equivalent modifications or changes made by those with ordinary skill in the art without departing from the purpose disclosed in this application shall still be covered by the claims of this application.

What is claimed is:

1. A water transportation system, the water transportation system comprising:

a water platform, the water platform includes a platform body and a platform extension;

a personal watercraft, the front part of the personal watercraft having a handlebar, the handlebar controls the steering of the personal watercraft;

wherein the handlebar has a locking device, and the platform extension is detachably connected to the personal watercraft through the locking device;

wherein the water platform is driven to move by a movement of the personal watercraft;

wherein the end of the platform extension is configured to be able to enter and exit the locking device so that the platform extension can be detachably connected to the personal watercraft;

wherein the locking device includes a pair of semi-closed rings, each semi-closed ring includes a first opening, and an end of the platform extension is configured to be able to enter and exit the pair of semi-closed rings through the first opening of each semi-closed ring so that the platform extension can be detachably connected to the personal watercraft.

2. The water transportation system according to claim 1, wherein a front part of the personal watercraft is connected to a rear end of the water platform.

3. The water transportation system according to claim 1, wherein the end of the platform extension is configured to be able to be moved in the height direction inside the locking device after entering the locking device.

4. The water transportation system according to claim 1, wherein the locking device further includes a pair of locking elastic bands, and the end of the platform extension is further bound to the handlebar through the pair of locking elastic bands.

5. The water transportation system according to claim 4, wherein the end of the platform extension includes a crossbar, the crossbar is configured to be able to enter and exit the pair of semi-closed rings and to be fastened to the handlebar by the locking elastic bands.

6. The water transportation system according to claim 5, wherein each of the semi-closed ring includes a top ring part, a bottom ring part, and a connecting part, wherein the connecting part connects the top ring part and the bottom ring part; wherein the crossbar is configured to enter the pair of semi-closed rings through the first opening between the top ring part and the bottom ring part.

7. The water transportation system according to claim 1, wherein the platform extension is configured to pivot about a side edge of the water platform between a direction parallel to the water surface and a direction perpendicular to the water surface.

8. The water transportation system according to claim 1, further comprising a second personal watercraft detachably connected to a second platform extension disposed on a front of the water platform.

* * * * *